United States Patent [19]

Guarino et al.

[11] 4,247,324

[45] Jan. 27, 1981

[54] METHOD AND APPARATUS FOR INTRODUCING SOLID SUBSTANCES INTO LIQUID METALS

[76] Inventors: Giovanni Guarino, Via Posidippo, 9 - AXA, Acilia, Roma; Alberto Praitoni, Via Cincinnato, 7 (Pal. 2), Pomezia, Roma, both of Italy

[21] Appl. No.: 38,179

[22] Filed: May 11, 1979

[30] Foreign Application Priority Data

May 12, 1978 [IT] Italy ..... 49327 A/78

[51] Int. Cl.³ ..... C21C 7/00

[52] U.S. Cl. ..... 75/53; 75/58; 75/129; 75/130 R; 75/130 A; 266/216

[58] Field of Search ..... 75/53, 58, 129, 130 R, 75/130 A

[56] References Cited

U.S. PATENT DOCUMENTS

| | | | |
|---|---|---|---|
| 2,662,008 | 12/1953 | Stone | 75/53 |
| 2,915,386 | 12/1959 | Strauss | 75/53 |
| 2,988,444 | 6/1961 | Hurum | 75/53 |
| 3,853,308 | 12/1974 | Rocher | 266/216 |
| 3,902,705 | 9/1975 | Easwaran | 266/216 |

*Primary Examiner*—P. D. Rosenberg

*Attorney, Agent, or Firm*—Young & Thompson

[57] ABSTRACT

Substances such as deoxidizing and desulfurizing substances are introduced into liquid metal such as molten iron or steel, by forming layers of active material such as an alkali or alkaline earth metal or an oxide or halide thereof, is interlayered with inert material, in a metallic casing. The inert material may be iron or steel or a metallic oxide that is inert to the bath. The composite is immersed in the bath, thereby gradually to add the deoxidizing and/or desulfurizing materials to the bath.

15 Claims, 3 Drawing Figures

METHOD AND APPARATUS FOR INTRODUCING SOLID SUBSTANCES INTO LIQUID METALS

The present invention relates to methods and apparatus for reducing the sulfur and/or oxygen contained in metal baths and to control the nature and form of the sulfur and/or oxygen compounds produced as a result of deoxy-desulfurizing treatments. The invention also relates to the elimination of the sulfur and/or oxygen compounds from the slag.

More particularly, the invention deals with the gradual introduction into metal baths, of deoxidizing and desulfurizing substances, particularly in ferrous baths, that is, baths of molten iron or steel.

It is accordingly an object of the present invention to provide methods and apparatus for introducing metallic and non-metallic deoxidizing and desulfurizing materials into a mass of molten metal, so as to obtain contact and to promote the reaction between the materials and components of the molten bath, in order to ensure that the sulfur and/or oxygen passes from the bath to the overlying phase or slag, or to give residual inclusions in the metal bath of such size and form and composition as not adversely to affect the mechanical properties and/or the machinability of the metal thus produced.

The present invention is based on the principle that active substances are added to the bath via an appropriate carrier in which they are present as discrete quantities separated by inert materials.

Various methods have been developed for the introduction of deoxy-desulfurizing materials into steel. For instance, they may be introduced into the bath:

as bodies in the form of ladle-sleeves made mainly by compacting deoxy-desulfurizing materials (e.g. Mg) with an inert material (e.g. coke breeze, dolomite, iron turnings, etc.)

as briquettes of material of the above type contained in non-metallic refractory or iron bells as projectiles fired into the metal as cored wires containing powdered deoxy-desulfurizing substances of controlled grain size (e.g. 0.1–0.5 mm)

as powders, 80 to 90% of which are finer than 1 mm, injected into the mass of the metal by means of a gaseous carrier with a fluidization ratio greater than 30 kg/Nm$^3$ as granular material coarser than 1 mm carried by gas with a fluidization ratio of less than 30 kg/Nm$^3$.

The drawback of gas-injection techniques is that they result in the dilution of deoxy-desulfurizing substances which gasify at bath temperature, thus reducing their tendency to react with the sulfur and oxygen of the bath and to dissolve in the liquid metal. Difficulties are also encountered in using non-metallic solid substances which are volatile at the bath temperature, since it is highly likely that the desulfurizing particles are contained in gas bubbles at least for part of the time they are beneath the surface of the metal bath. This results in a faster rate of rise than might otherwise be expected considering both particles and bath density. There is also a decrease in the actual instantaneous contact between the surface of the solid particle and the liquid metal.

The techniques involving the introduction of deoxy-desulfurizing materials, which vaporize at the temperature of the liquid metal, in form of ladle-sleeves mounted on rods or as briquettes in bells often suffer from the disadvantage of having excessively long gaseous material release times (more than ten minutes) compared with the process times.

Furthermore with these techniques there is a maximum limit for the active material that can be contained in the carrier units. This limit depends on the nature of the inert material and the binder, the bath temperature and the effect of the latter on the reactions between the components of the body (e.g. formation of alkaline earth carbides).

In addition to these disadvantages, there is also the decrease in the yield of the element released by the bodies owing to chemical reaction with the refractories of the sleeves and/or the bells and the pollution of the bath by substances contained in the support of the active elements.

In the case of non-polluting inert materials such as iron turnings, the effect which the addition has on the bath temperature is by no means negligible.

The technique involving the use of sleeves mounted on stopper rods (rods used to block the holes through which the metal flows from the vessel) is much more adaptable than that of the bell-mounted bodies in the case of addition of nonmetallic substances which vaporize at the liquid metal temperature.

However, the known systems for preparing bodies of the type mentioned above, do not generally ensure the intimate contact between the liquid metal and the desulfurizing substances (liquid or solid), needed to exploit the properties of the latter to the full.

The cored-wire technique is subject to very marked difficulties as regards the initial state of the substances when the wire is filled, owing to the manufacturing procedure adopted (e.g. the filling of skeins of welded tubes for drawing necessitates the use of powders of carefully controlled particle size to suit the slope of the vibrating plane which serves as a support for the skein itself). As regards the actual fabrication technique, there are very considerable constraints on the wirefilling ratio (kg Fe/kg active substance).

All the above methods, including that involving the use of projectiles, suffer from the drawback of not permitting the uniform, simultaneous treatment of the whole volume of liquid in a large vessel with a desired quantity of substance so as to obtain sulfide and/or oxide inclusions of the desired dimensions (often of the order of 1 $\mu$m).

As regards the deoxy-desulfurizing substances used to date with the various techniques referred to earlier, it should be observed that the oxygen and/or sulfur are usually distributed between the metallic bath and the slag, the slag protecting the bath against the oxidizing action of the air.

The protective role of the slag, i.e. its ability to retain and/or eliminate oxygen and sulfur from the bath, is largely dependent on the oxygen potential immediately above it and the oxygen potential of the bath. The latter, in turn, depends also on the nature of the refractories.

In any case, because of these factors it is necessary to have large quantities of highly basic slag (more than 10 kg/ton of steel, of slag having a basicity of 4 to 5) and/or to cover this with substances having a strong affinity for oxygen (e.g. powdered carbon) so as to limit the return of sulfur from the slag to the molten metal.

The present invention enables all these difficulties to be overcome and provides advantages which are set forth hereinafter.

The invention is based on the principle of adding the active substances to the bath by a special hollow carrier wherein they are contained in discrete quantities separated by inert materials. In one particular embodiment, the active substance is interlayered with inert material.

The inert material can be metal sheet, sponge metal or metal powder and the metal can be iron or steel. The inert material can also take the form of other compounds, for instance inert oxides, especially alumina.

The volume of each of the discrete or active substances may range from 0.1 to 5 $dm^3$, while the thickness of the inert material separating them may range from 0.1 to 20 mm.

The ratio of inert material to active material in the alternate layers can be about 2:1 to about 6:1.

The elongated container may be made of metal sheet (e.g. iron or steel) and it may or may not have holes for the outflow of gaseous materials and it may or may not be clad with a layer of refractory material between 0.1 and 50 mm thick. The container may be mounted on a tubular rod, through which inert gas may or may not flow, for introducing the materials into the mass of the liquid metal conjointly with a gas that can also treat the bath or that can merely stir the bath.

It has been found, surprisingly, that by operating according to the invention, the active substances are released slowly, at the same time producing drastic desulfuration of the bath and with advantageous effects as regards the nature and form of the inclusions.

The use of the method according to the invention proves particularly interesting where the active substance is a mechanical mixture of alkali or alkaline earth halides, and oxides of the same metals. In this case the discrete distribution of the active material provides a more pronounced desulfurizing effect than would be expected.

This unexpected result can perhaps be explained by the formation of volatile compounds by the sulfur and the halogen contained in the slag, which separate from the metal/slag system.

In this way it is possible to ensure desulfuration of metal baths while greatly reducing the danger of the sulfur being transferred back to the slag owing to the oxidizing effect of the air.

Other features, objects and advantages of the present invention will become apparent from a consideration of the following description, taken in connection with the accompanying drawing, in which.

Figure 1:
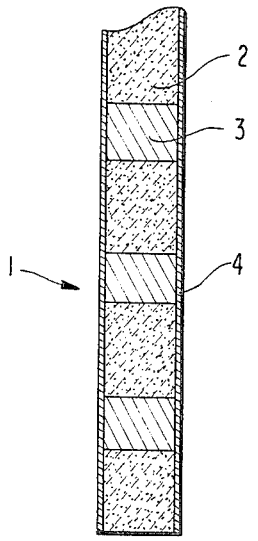
FIG. 1 is a fragmentary longitudinal cross-sectional view of a first embodiment of the present invention.

Referring now to the drawing in greater detail, there is shown in FIG. 1 a first embodiment of the invention, comprising a vertically elongated cylindrical body 1 made up of alternate layers 2 and 3 of inert material and active material, respectively, disposed within a cylindrical sheet metal sheath 4. Sheath 4 can be iron or steel. Inert material 2 can be iron or steel or an oxide inert to the bath, such as alumina. Active material 3 can be alkali or alkaline earth metal or an oxide or halide thereof. Examples of the active metals are sodium, magnesium, calcium, lithium, potassium, rubidium, cesium, beryllium, strontium or barium or a mixture thereof. The preferred halide is the chloride.

The layers 2 and 3 can be in the form of solid pieces such as blocks or sheets, or in the form of a solid sponge or a spongy material, or compacted powders. Particle size is accordingly irrelevant, except for ease of fabrication.

However, the thickness of the inert layers 2 should be from 0.1 to 20 mm. The volume of each layer of active material should be 0.1 to 5 $dm^3$. The weight ratio of inert material to active material is preferably in the range about 2:1 to about 6:1. The thickness of the sheath 4 is immaterial, but it will ordinarliy be of sheet iron or sheet steel.

Figure 2:
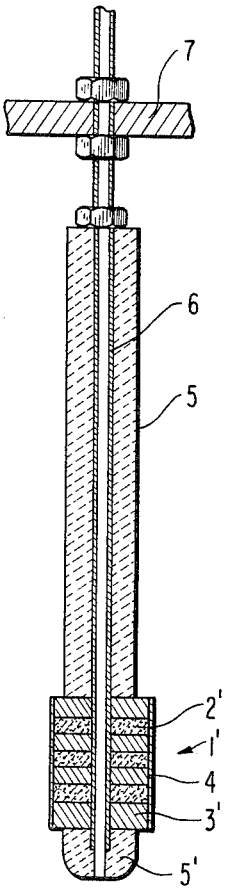
FIG. 2 is a view similar to FIG. 1 but of a second embodiment of the invention.

FIG. 2 shows a modified form of the invention, in which the vertically elongated cylindrical body 1' is comprised of annular layers 2' and 3' within a cylindrical casing 4. Cylindrical body 1' is carried by a stopper rod 5 of ceramic material or the like, having a metal conduit 6 extending therethrough, conduit 6 passing all the way through stopper rod 5 and cylindrical body 1' and terminating in ceramic tip 5' of stopper rod 5. An inert gas such as argon or the like can be introduced through conduit 6 for purposes of stirring or otherwise treating the bath; or the gas that is introduced through conduit 6 can be active with respect to the bath. In other words, the gas will always stir the bath, and may or may not in addition otherwise treat the bath.

The device of FIG. 2 is suspended from a hanger 7 over the bath, by which it may also be introduced into and withdrawn from the bath.

Figure 3:
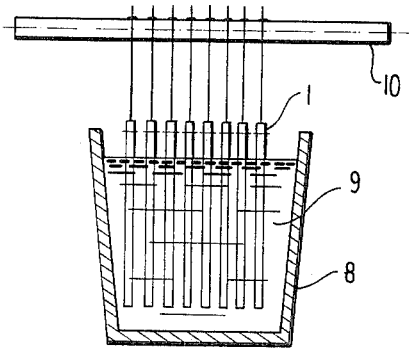
FIG. 3 is an elevational view, partly in cross-section, of apparatus according to the present invention, as more particularly seen in FIG. 1, in use in the practice of the method according to the invention.

FIG. 3 shows very schematically how the present invention can be practiced. A ladle 8 contains molten iron 9 into which is introduced a plurality of the cylindrical bodies 1 as in FIG. 1, all supported in common from a support 10 by which they may also be lowered into and raised from the bath by conventional means (not shown).

To enable those having ordinary skill in this art to practice the invention, the following illustrative examples are given:

EXAMPLE 1

A steel bath not killed with aluminum, without any covering slag, having essentially the composition (percent by weight) C 0.07, Mn 1.55, Si 0.3, Nb 0.06, Mo 0.3, balance essentially iron, was contained in a 1000 mm-deep ladle open to the air and lined with a refractory containing more than 70% $Al_2O_3$.

The steel bath was treated with 0.6 kg/ton of Ca-Si alloy (70% Si). The alloy was contained in the cylindrical body of FIG. 1 immersed in the bath, the body having an outside diameter of 200 mm, and the weight ratio Fe:Ca-Si was 6:1, the inert material being iron turnings.

At the end of the treatment, which lasted less than three minutes, the bath temperature had dropped from 1600° C. to 1585° C. and the concentration of calcium in the bath was 70 ppm. After about five minutes, calcium had dropped to 50 ppm. This reduction was accompanied by a decrease in the total oxygen content from 70 ppm to 50 ppm. The S content was not influenced by the treatment.

Inspection under the microscope revealed the presence in the metal of globular calcium silicate inclusions, whose average diameter was less than 5 μm, sometimes associated with CaS.

The same metallurgical results were obtained when the Ca-Si (70% Si) alloy was replaced by a mixture of calcium and silicon (70%).

These tests were replaced using an Fe:Ca-Si ratio of 3:1. The same metallurgical effects were observed, together with a temperature drop during addition of not more than 5° C.

All the foregoing tests were repeated in a bath covered with 10 kg $CaO-Al_2O_3$ (50% $Al_2O_3$) slag per ton of steel. A decrease in the initial sulfur content (around 150 ppm) to 120 ppm was observed. After an average of about 15 minutes following the addition, the amount of sulfur in the bath dropped to 80 ppm. At the end of the test the residual calcium in the bath was always less than 120 ppm and the oxygen content had risen from 30 ppm to 60 ppm.

EXAMPLE 2

The test described in Example 1 was repeated with a bath containing 0.03% aluminum at a temperature of 1560° C.

Immediately after the addition, which took about thirty seconds, the temperature dropped to about 1550° C. and the analysis of the metal revealed the presence of 60 ppm of Ca, 200 ppm of Al and 30 ppm of 0. No decrease in sulfur was observed (about 150 ppm).

Metallographic inspection indicated the presence in the bath of round inclusions of calcium aluminate, sometimes associated with CaS, and isolated inclusions of CaS having an average diameter of less than 5 μm.

When the Ca-Si alloy (70% Si) was replaced by a mixture of calcium and silicon in the same ratio as that of the alloy, the same metallurgical results were obtained. A temperature drop of about 5° C. was observed in this test.

The above tests were repeated using an Fe:Ca-Si ratio of 3:1. The same metallurgical effects were observed as in the corresponding tests described above, with a negligible temperature drop.

All the previous tests were repeated after covering the bath with 8 kg $CaO-Al_2O_3$ (50/50) slag per ton of steel.

An average initial decrease in sulfur content from 160 to 130 ppm was observed. The final oxygen content remained around 20 ppm on the average. Thirty minutes after the addition no significant increase in sulfur and oxygen contents of the steel was noted. The residual calcium averaged 25 ppm.

EXAMPLE 3

The steel bath of Example 2, contained in a MgO-lined crucible, was treated with 3 kg of a mixture consisting of MgO (22%), CaO (53%) and $CaCl_2$ (25%) per ton of steel. The mechanical mixture was contained in a cylindrical sheath of sheet iron, with an outside diameter of 200 mm.

The ratio of inert material (iron turnings) to active substance was 2:1.

The container was immersed in the liquid steel by means of the device illustrated in FIG. 2. During the test a stream of argon was passed through the stopper rod at a rate of 500 N $dm^3$/minute.

Three minutes after treatment had started the S content had fallen from 150 ppm to 30 ppm. Five minutes after the start, the argon was switched off. Thirty minutes from that moment the S content of the bath had risen from 30 to 45 ppm.

The slag remaining on the surface of the bath contained 1% chlorine and 0.3% S.

Metallographic inspection revealed the presence of globular calcium aluminate inclusions which appeared to be the same as those obtained by blowing $CaO-CaF_2$ slag into the steel.

It was found that the fumes coming from the bath consisted of dusts containing up to 0.5% sulfur, only part of which was present as sulfides.

Other tests run on the same furnace using the same lining at an argon pressure of 300 torr have shown that as the pressure decreases so does the sulfur content in the fumes, while S in the form of sulfides disappears.

This phenomenon may be explained by assuming absorption of chlorinated compounds of sulfur on the fume dusts. One of these ($SCl_2$) is thermodynamically stable at 1600° C., but at room temperature it decomposes according to the reaction $$2\ SCl_2 \rightleftharpoons S_2Cl_2 + Cl_2$$

This reaction seems to offer the key for explaining the observed phenomenon.

From a consideration of the foregoing disclosure, therefore, it will be evident that the initially recited object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method for the introduction of deoxy-desulfurizing substances into metal baths, comprising forming in a hollow tube a plurality of discrete quantities of a said substance separated by material inert to the bath, and immersing the tube in the bath, the active material being a mixture of at least one alkali or alkaline earth metal halide, on the one hand, and the oxide of the same alkali or alkaline earth metal on the other hand.

2. A method as claimed in claim 1, in which said tube is immersed vertically in the bath.

3. A method as claimed in claim 1, in which said active material and inert material are disposed in alternate layers in the tube.

4. A method as claimed in claim 1, in which the volume of the discrete quantities of active material is from 0.1 to 5 $dm^3$.

5. A method as claimed in claim 1, in which the thickness of the layers of inert material is between 0.1 and 20 mm.

6. A method as claimed in claim 1, in which the inert material is selected from the group consisting of iron, steel and metal oxide or halide which is inert to the bath.

7. A method as claimed in claim 1, in which the range of ratios of inert material to active material is about 2:1 to about 6:1.

8. Apparatus for the introduction of deoxy-desulfurizing substances into metal baths, comprising a hollow tube, and in the tube a plurality of discrete quantities of a said substance separated by material inert to the bath, the active material being a mixture of at least one alkali or alkaline earth metal halide, on the one hand, and the oxide of the same alkali or alkaline earth metal on the other hand.

9. Apparatus as claimed in claim 8, in which said active and inert materials are disposed in alternating layers in the tube.

10. Apparatus as claimed in claim 9, in which the layers of inert material are between 0.1 and 20 mm thick.

11. Apparatus as claimed in claim 8, in which the volume of the discrete quantities of active material is from 0.1 to 5 $dm^3$.

12. Apparatus as claimed in claim 8, in which inert material is selected from the group consisting of iron, steel, and metal oxide which is inert to the bath.

13. Apparatus as claimed in claim 8, and means to blow a gas through the cylindrical body along the axis thereof and into the bath.

14. A method as claimed in claim 1, in which all said discrete quantities of said substance are the same said substance.

15. Apparatus as claimed in claim 8, in which all said discrete quantities of said substance are the same said substance.

* * * * *